US005588380A

United States Patent [19]

LaRose

[11] Patent Number: 5,588,380

[45] Date of Patent: Dec. 31, 1996

[54] DIFFUSER FOR COAL NOZZLE BURNER

[75] Inventor: Jeffrey A. LaRose, Stow, Ohio

[73] Assignee: The Babcock & Wilcox Company, New Orleans, La.

[21] Appl. No.: 448,206

[22] Filed: May 23, 1995

[51] Int. Cl.[6] ..... F23D 1/00

[52] U.S. Cl. ..... 110/263

[58] Field of Search ..... 110/261, 262, 110/263, 264, 265; 431/183

[56] References Cited

U.S. PATENT DOCUMENTS

| | | | |
|---|---|---|---|
| 2,912,942 | 7/1954 | Whitney Jr. et al. | 110/104 |
| 3,074,361 | 9/1958 | Huge et al. | 110/104 |
| 4,380,202 | 4/1983 | LaRue et al. | 110/263 |
| 4,479,442 | 10/1984 | Itse | 110/261 |
| 4,597,342 | 7/1986 | Green et al. | 110/261 |
| 4,630,554 | 12/1986 | Sayler et al. | 110/264 |
| 4,654,001 | 3/1987 | LaRue | 431/354 |
| 4,924,784 | 5/1990 | Lennon et al. | 110/261 |

FOREIGN PATENT DOCUMENTS

| | | | |
|---|---|---|---|
| 1016631 | 5/1983 | U.S.S.R. | 110/264 |
| 1179018 | 9/1985 | U.S.S.R. | 110/264 |
| 228507 | 4/1925 | United Kingdom | 110/264 |
| 330198 | 6/1930 | United Kingdom | 110/261 |

*Primary Examiner*—Noah P. Kamen

*Attorney, Agent, or Firm*—Robert P. Bennett, Jr.; Robert J. Edwards

[57] ABSTRACT

A diffuser for a coal burner has a coal nozzle with an axis and an inner surface. The diffuser comprises a reducing area cone which has tapering upstream and downstream ends, for positioning in a coal nozzle at the coal nozzle axis. A frusto-conical shroud has a small diameter upstream end and a large diameter downstream end, positioned around the reducing area cone. A plurality of support legs is connected to the reducing area cone and extends radially outwardly through the shroud for connecting to the coal nozzle. Each of the support legs is inclined at an acute angle to the axis of the coal nozzle for evenly spreading pulverized coal supplied through the coal nozzle and past the diffuser.

9 Claims, 2 Drawing Sheets

DIFFUSER FOR COAL NOZZLE BURNER

BACKGROUND OF THE INVENTION

1. Field of the Invention

Conical diffusers are routinely used in burner coal nozzles to distribute the coal around the peripheral. Previous experience suggests that if the coal particles can be evenly distributed around the inside surface of the coal pipe, then combustion efficiency will improve. This translates into lower unburned carbon losses and potentially lower nitrous oxide emissions.

2. Description of the Related Art

U.S. Pat. No. 4,380,202 illustrates a mixer for a dual register burner with a diffuser including a reducing area cone, identified as an "oblong-diamond shaped plug", and frusto-conical shroud co-axially surrounding the plug. Plug supports rigidly fix the plug to the inside of the shroud. The plug supports are shaped to minimize the flow resistance to the air entrained pulverized fuel. No further disclosure is provided concerning the number of plug supports and, in the illustration of the reference, only two supports are shown, which are parallel to the axis of the diffuser.

U.S. Pat. No. 4,479,442 is directed to a venturi nozzle for pulverized coal including a divergent flow spreader that is provided with plural swirl vanes.

U.S. Pat. No. 2,912,942 shows a pulverized fuel burner with vanes circumferentially spaced apart. They are triangular-shaped in cross-section and their apexes face the burner axis. The vanes are located on the inner surface of a frusto-conical shroud.

SUMMARY OF THE INVENTION

The invention is drawn to a support leg arrangement for a conical diffuser designed to improve the distribution of pulverized coal around the periphery of a coal nozzle in a coal burner. According to the invention a reducing area cone is designed with four (4) support legs equally spaced around the reducing area cone, and between the cone and a frusto-conical shroud. All four legs are angled at an acute angle to the burner axis, specifically ten degrees.

Use of four angled support legs makes the diffuser unique relative to previous designs which used two support legs that are parallel to the nozzle axis since a highly advantageous and unexpected flow pattern is created.

Accordingly, an object of the present invention is to provide a diffuser for a coal burner having a coal nozzle with an axis and an inner surface, the diffuser comprising: a reducing area cone having tapering upstream and downstream ends, for positioning in a coal nozzle at the coal nozzle axis; a frusto-conical shroud having a small diameter upstream end and a large diameter downstream end, positioned around the reducing area cone; and a plurality of support legs connected to the reducing area cone and extending radially outwardly through the shroud for connecting to the coal nozzle, each of the support legs being inclined at an acute angle to the axis of the coal nozzle for evenly spreading pulverized coal supplied through the coal nozzle and past the diffuser.

A further object of the invention is to utilize four support legs which are each in the form of flat plates, and are each inclined at approximately 10° to the axis of the coal nozzle.

A further object of the invention is to provide an improved diffuser for a coal nozzle which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which a preferred embodiment of the invention is illustrated.

DESCRIPTION OF THE PREFERRED EMBODIMENT

Figure 1:
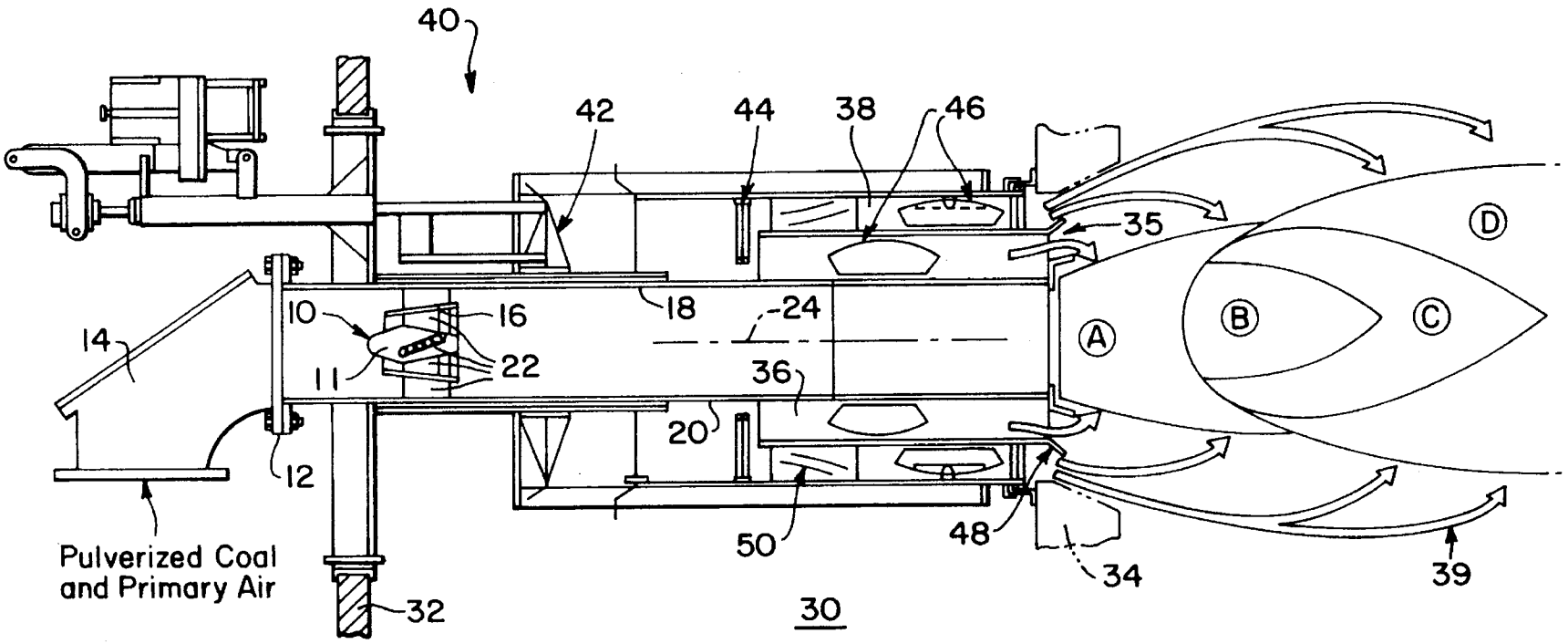
FIG. 1 is a axial sectional view of a coal burner incorporating the diffuser of the present invention.

A typical burner with the conical diffuser of the invention is shown in FIG. 1. The diffuser 10 is located near the exit end 12 of an upstream pipe elbow 14, to redistribute the coal. A reducing area cone or frusto-conical shroud 16 traps some of the coal and pushes it toward the inner surface 18 of a coal nozzle 20. The diffuser 10 of the invention contains four support legs 22 which are at an angle to the nozzle axis 24.

Figure 2:
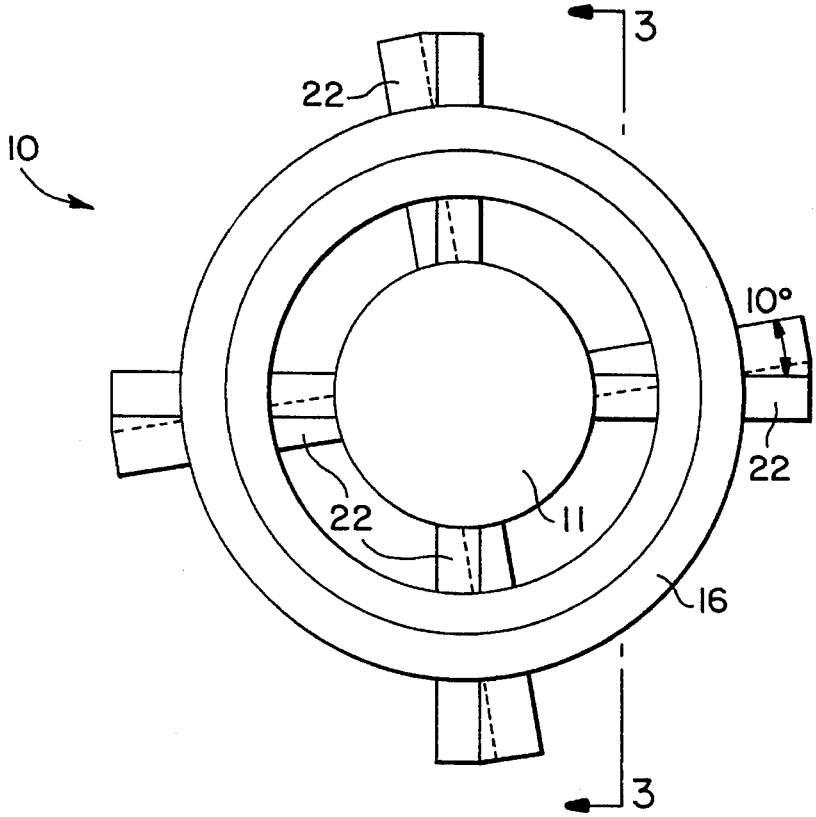
FIG. 2 is a rear elevational view of the diffuser of the present invention.
Figure 3:
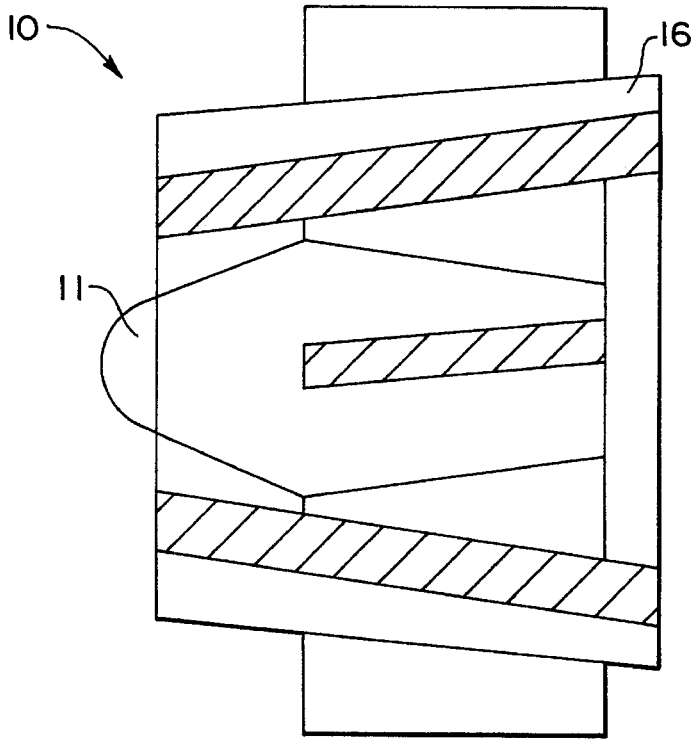
FIG. 3 is a sectional view taken along line 3—3 of FIG. 2.

The conical diffuser 10 of the invention has been developed to improve the coal distribution around the peripheral of the coal nozzle 20. The new conical diffuser 10 retains the reducing area cone 11 of prior designs, but adds additional support legs. All four of the support legs 22 are angled at ten degrees; see FIG. 2. The use of four angled support legs 22 makes this diffuser unique from any previous designs.

This arrangement has the advantages of a better coal distribution, and is more tolerant of coal roping upstream of the coal nozzles.

The new diffuser 10 was quantitatively tested by the inventor using an existing coal pipe arrangement with a typical coal to air loading. The air velocity profile at the end of the burner nozzle for the inventive diffuser showed substantial improvement over the prior art in evenly distributing coal. The coal particle velocity through the diffuser 10 to the end of the nozzle 20 was also improved. The new design has a much better distribution around the peripheral with a lower velocity core in the center than the prior art. The new design added one-third of an inch water gage draft loss in achieving the improved distribution for this arrangement and loading.

Coal roping occurs in the transport process of the particulate (coal) being carried by the air. Particulate is dragged by the flowing medium causing it to lag in changes in flow patterns due to piping. This allows the coal to become concentrated, and travel in a small portion of the piping cross section. This "rope" of coal travels through the piping to the burner nozzle. The diffuser 10 of the invention with its four angled support legs 22 helps to break the concentrated coal rope which provides a better coal distribution.

These improvements will show up at coal fired boilers by reducing the unburned carbon losses, and lowering the nitrous oxide emissions.

Returning to FIG. 1, the burner into which the diffuser 10 of the present invention is installed, is generally designated 40 and is mounted in a windbox 30 defined between an outer wall 32 and an inner wall 34 of a furnace. Elbow 14 is connected to a source of primary air and pulverized or otherwise particulate coal. The coal is supplied along coal nozzle 20 and creates a flame having different portions labeled A, B, C and D in FIG. 1.

An annular inner secondary air space 36 is defined around the outlet or downstream end of coal nozzle 20, and supplies secondary air around the base of the flame to form high temperature-fuel rich devolatilization zone A. At 35, some of the inner secondary air is recirculated to the base of the flame.

An outer secondary air zone 38 is defined around the inner zone for supplying an outer secondary air mixture 39 which mixes with the flame to form reducing species in zone B, $NO_x$ decomposition in zone C and char oxidizing in zone D. A slide damper 42 adjusts the air flow to the secondary zones 36 and 38 which is measured by an air measuring device 44. Adjustable spin vanes 46 are provided in the inner and outer secondary air zones 36 and 38. An air separation plate 48 is provided between the inner and outer secondary air zones 36 and 38 and also at the outlet end of coal nozzle 20 for shaping the flame and directing the air flows. Spin vanes 50 may also be provided in the upstream end of the outer secondary air zone for further modifying the characteristics of the flame.

While a specific embodiment of the invention has been shown and described in detail to illustrate the application of the principles of the invention, it will be understood that the invention may be embodied otherwise without departing from such principles.

What is claimed is:

1. A diffuser for a coal burner having a coal nozzle with an axis and an inner surface, the diffuser comprising:

a reducing area cone having tapering upstream and downstream ends, for positioning in a coal nozzle at the coal nozzle axis;

a frusto-conical shroud having a small diameter upstream end and a large diameter downstream end, positioned around the reducing area cone; and a plurality of support legs fixed rigidly to the reducing area cone and extending radially outwardly through the shroud for fastening to the coal nozzle, each of the support legs being inclined at an acute angle to the axis of the coal nozzle for evenly spreading pulverized coal supplied through the coal nozzle and past the diffuser.

2. A diffuser according to claim 1, wherein the acute angle is approximately 10°.

3. A diffuser according to claim 2, including four support legs fixed rigidly to the reducing area cone and equally spaced around the axis of the coal nozzle.

4. A diffuser according to claim 3, wherein each of the legs is a flat plate.

5. A burner for burning particulate coal comprising:

means defining a windbox;

a coal nozzle extending through the windbox along a nozzle axis;

a diffuser in the nozzle, the diffuser comprising a reducing area cone having tapering upstream and downstream ends, for positioning in a coal nozzle at the coal nozzle axis;

a frusto-conical shroud having a small diameter upstream end and a large diameter downstream end, positioned around the reducing area cone; a plurality of support legs fixed rigidly to the reducing area cone and extending radially outwardly through the shroud for fastening to the coal nozzle, each of the support legs being inclined at an acute angle to the axis of the coal nozzle for evenly spreading pulverized coal supplied through the coal nozzle and past the diffuser;

means defining inner and outer secondary air zones around an outlet end of the coal nozzle for supplying secondary air from the windbox to an area around an outlet end of the nozzle; and means for providing particulate coal and primary air to the coal nozzle.

6. A burner according to claim 5, including spin vanes in each of the inner and outer secondary air zones.

7. A burner according to claim 6, wherein the acute angle is approximately 10°.

8. A burner according to claim 7, including four support legs fixed rigidly to the reducing area cone and equally spaced around the axis of the coal nozzle.

9. A burner according to claim 8, wherein each of the legs is a flat plate.

* * * * *